US006608435B1

(12) United States Patent
Kimiya et al.

(10) Patent No.: US 6,608,435 B1
(45) Date of Patent: Aug. 19, 2003

(54) CATHODE RAY TUBE APPARATUS WITH ELECTRON BEAM FORMING STRUCTURE

(75) Inventors: Junichi Kimiya, Kumagaya (JP); Syunji Ookubo, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 114 days.

(21) Appl. No.: 09/614,170

(22) Filed: Jul. 11, 2000

(30) Foreign Application Priority Data

Jul. 12, 1999 (JP) ..... 11-197203
Apr. 26, 2000 (JP) ..... 2000-126072

(51) Int. Cl.[7] ..... H01J 29/50
(52) U.S. Cl. ..... 313/412; 313/413; 313/440
(58) Field of Search ..... 313/413, 440, 313/442; 315/382.1, 368.15, 368.16, 412

(56) References Cited

U.S. PATENT DOCUMENTS 3,049,641 A * 8/1962 Gleichauf ..... 315/30
4,319,163 A 3/1982 Chen
5,519,290 A 5/1996 Sugawara et al.
5,585,690 A * 12/1996 Misono ..... 313/413
5,694,004 A * 12/1997 Kimiya et al. ..... 315/15
5,719,475 A * 2/1998 Shishido ..... 315/368.15
6,166,483 A * 12/2000 Chen et al. ..... 313/414
6,339,293 B1 * 1/2002 Kimiya et al. ..... 315/15
2002/0024284 A1 * 2/2002 Oda et al. ..... 313/413

FOREIGN PATENT DOCUMENTS

JP 61-99249 5/1986
JP 61-250934 11/1986
JP 2-72546 3/1990
JP 8-87967 4/1996
JP 2001084922 A * 3/2001 ..... H01J/29/48

OTHER PUBLICATIONS

Griffiths, David J., Introduction to Electrodynamics, 1981, Prentice–Hall, Inc., p. 157 Table 4.2.*

* cited by examiner

*Primary Examiner*—Ashok Patel
*Assistant Examiner*—Glenn Zimmerman
(74) *Attorney, Agent, or Firm*—Oblon, Spivak, McClelland, Maier & Neustadt, P.C.

(57) ABSTRACT

In a cathode ray tube apparatus, an electron beam generating section for generating electron beams is composed of a cathode and a plurality of electrodes. Two electrodes of the plurality of electrodes are connected to each other via a resistor. A constant voltage is supplied from the outside of the tube to the one electrode, and a voltage dynamically changed in synchronism with a deflection magnetic field is supplied to an electrode adjacent to the other electrode. Therefore, the shape of a beam spot can be improved, and the resolution of the entire screen can be improved without requiring extensive provision of a lead wire of a stem.

42 Claims, 6 Drawing Sheets

CATHODE RAY TUBE APPARATUS WITH ELECTRON BEAM FORMING STRUCTURE

CROSS-REFERENCE TO RELATED APPLICATIONS

This application is based upon and claims the benefit of priority from the prior Japanese Patent Applications No. 11-197203, filed Jul. 12, 1999; and No. 2000-126072, filed Apr. 26, 2000, the entire contents of which are incorporated herein by reference.

BACKGROUND OF THE INVENTION

The present invention relates to a cathode ray tube apparatus. In particular, the present invention relates to a cathode ray tube apparatus incorporating an electron gun assembly capable of compensating for dynamic astigmatism.

In general, a color picture tube 11, as shown in FIG. 1, has an envelope consisting of a panel 10 and a funnel 14 coupled integrally with this panel. On an interior face of this panel 14, there is formed a phosphor screen consisting of a stripe or dot shaped three-color phosphor layer that emits blue, green, and red lights, that is, a target 12. A shadow mask 13 having a number of apertures at its inside is mounted in opposite to this phosphor screen 12. On the other hand, an electron gun assembly 17 for emitting three electron beams 16B, 16G, and 16R is arranged in a neck 15 of the funnel 14. Then, the three electron beams 16B, 16G, and 16R emitted from this electron gun assembly 17 are deflected by horizontal and vertical deflecting magnetic fields generated from a deflection yoke 19 mounted on the funnel 14, and are directed to the shadow mask 13. The phosphor screen 12 is scanned horizontally and vertically with the electron beams 16B, 16G, and 16R passing through the shadow mask 13 so that a color image is displayed.

In such a color picture tube, in particular, an electron gun assembly 17 has an inline type structure for emitting three electron beams 16B, 16G, and 16R in line, consisting of a center beam 16G and a pair of side beams 16B and 16R on both sides thereof. In addition, a side beam through hole of a grid located at a relatively low voltage side and a side beam through hole of a grid located at a high voltage side grid, both forming a main lens portion of the electron gun assembly are not aligned and are eccentrically arranged. As a result, there is widely used practically a self convergence system inline type color picture tube in which three electron beams are converged at a screen center, a pin cushion shaped horizontal deflection magnetic field and a barrel shaped vertical deflection magnetic field are generated by a deflection yoke 19, and the three electron beams 16B, 16G, and 16R emitted in line are self converged on a screen area.

In such a self-convergent inline type color cathode ray tube, the electron beams passing through the non-uniform magnetic field is subject to the astigmatism. For example, as shown in FIG. 2A, the electron beams 16B, 16G, and 16R are subjected to forces indicated by arrows 3H and 3V by the pin cushion shaped magnetic field 1. As a result, as shown in FIG. 2B, a beam spot 4 of an electron beam is distorted on the periphery of the phosphor screen. The deflection aberration to which these electron beams are subjected occurs because the electron beams enter an excessively focused state in the vertical direction, and a halo 5 (blurring) is generated in the vertical direction. The deflection aberration to which the electron beams are subject becomes greater as the tube becomes larger, and the deflection becomes wider. Then, the resolution of the phosphor screen periphery is significantly degraded.

Means for solving degradation of the resolution due to such deflection aberration is disclosed in Japanese Patent Application Laid-open Nos. 61-99249, 61-250934, and 2-72546. These electron gun assemblies each, as shown in FIG. 3, consist of a first grid G1 to a fifth grid G5. An electron beam generating section GE, a quadruple lens QL, and a final focusing lens EL are formed along the traveling direction of the electron beam. As shown in FIG. 4A and FIG. 4B, two trios of asymmetrical electron beam through holes 7B, 7G, 7R, 8B, 8G, 8R each are provided on an opposite face of the respective grids G3 and G4, and the quadruple lens QL of each electron gun assembly is formed.

The lens powers of these quadruple lens QL and final focusing lens EL are changed in synchronism with the magnetic field of the deflection yoke, whereby the deflection aberration applied to the electron beams deflected at the periphery of the screen due to the deflection magnetic field is corrected. In this manner, a beam spot having a good spot shape in the screen can be obtained.

However, even if such correcting means is provided, the deflection aberration due to the deflection yoke is strong. Even if a halo portion of the electron spot can be eliminated, but the horizontal elongated phenomenon in which the electron beam spot is deformed in a horizontal direction cannot be corrected. In order to correct this horizontal elongation phenomenon, it is required not only to correct the deflection aberration due to the quadruple lens QL, but also to correct the beam shape at an electron beam generating section in synchronism with the deflection magnetic field.

Such color picture tube apparatuses are disclosed in U.S. Pat. No. 4,319,163 and Japanese Patent Application Laid-open No. 8-87967. In these color picture tube apparatuses disclosed in these publications, a second grid is divided into two sections. A grid on the first grid side of the second grid has a circular electron beam through hole, and a grid on a third grid side of the second grid has an horizontally elongated electron beam through hole. In an electron gun assembly of this tube apparatus, a focusing power of a main lens portion is changed, and a dynamic voltage synchronized with a deflection current of a deflection device is applied to the grid on the third grid side. According to such color picture tube apparatus, at a triode portion for generating electron beams, electron beams are dynamically controlled in synchronism with the deflection current of the deflection device, and the focused states of the main lens and the quadruple lens arranged at the main lens are changed. Therefore, according to such structured electron gun assembly, a horizontal deformed phenomenon can be eliminated more significantly, and electron beams can be focused at the periphery of the screen more properly than a conventional dynamic focus electron gun assembly in which the focused states of the main lens and the quadruple lens disposed in the vicinity of the main lens are changed.

However, in the color picture tube device disclosed in the aforementioned publication, from the outside of the color picture tube apparatus, it is required to apply a focus voltage having an intermediate level; a dynamic focus voltage which increases in synchronism with the deflection current of the deflection device with the focus voltage having the intermediate level being a reference; a acceleration voltage having low level applied to the grip on the first grid side of the second grid; and a dynamic focus voltage that increases in synchronism with the deflection current of the deflection device applied to the third grid side of the second grid with this low level acceleration voltage being a reference.

In such electron gun assembly, in comparison with an electron gun assembly for a color picture tube device it is required to newly apply a dynamic focus that performs general dynamic focus, voltage that increases in synchronism with the deflection current of the deflection device with the acceleration voltage having the low level being a reference. In addition, it is required to newly provide a lead wire for supplying a voltage to a stem portion. For this reason, there is a possibility of lowering withstanding voltage characteristics due to an addition of this lead wire, and there is a problem in reliability. In addition, in the color picture tube apparatus provided with this lead wire, re-designing of the stem portion is required. Further, in a driving device for supplying a voltage also, it is required to newly add a circuit for generating this dynamic voltage, and there is a problem that such circuit addition causes higher cost.

As described above, in a color cathode tube of self-convergence inline type, non-uniform deflection magnetic field is generated from a deflection yoke. Thus, the astigmatism is applied to electron beams in the deflection magnetic field, and the beam spot at the periphery of the screen is distorted. For this reason, the resolution of the periphery of the screen is significantly degraded.

As means for solving degradation of the resolution due to such deflection aberration, a voltage that changes in synchronism with the deflection magnetic field is applied to a grid that forms a final focusing lens of the electron gun assembly, and a quadruple lens is formed in the vicinity of the final focusing lens. With such arrangement, there is provided an electron gun assembly having a dynamic focus system such that a deflection aberration resulting from a deflection magnetic field can be compensated. However, in this dynamic focus system electron gun assembly, a halo of the beam spot can be eliminated, but the horizontal deformation of the beam spot cannot be corrected. Therefore, there is a problem that the resolution of the periphery of the screen cannot be well improved.

As a color picture tube that improves the resolution of the periphery of the screen, focusing power of the main lens is changed in synchronism with the deflection magnetic field, and the shape of electron beams is corrected at the electron beam generating section. However, in such color picture tube, there must be additional provided a lead wire for supplying to a stem a dynamic voltage. There is a possibility that the withstanding voltage characteristics of the stem are degraded due to an addition of the lean wire, and there is a problem in reliability. In addition, it is required to newly design a stem. Further, with respect to the driving circuit for supplying a voltage, it is required to newly provide a circuit for supplying a dynamic voltage, and there is a problem that such circuit provision causes higher cost.

BRIEF SUMMARY OF THE INVENTION

It is an object of the present invention to provide a cathode ray tube apparatus comprising an electron gun assembly that improves the shape of a beam spot and improves the resolution of image on the overall of the screen without requiring extensive provision of a stem lead wire.

According to the present invention, there is provided a cathode ray tube comprising: an electron beam generating section; an electron gun assembly having a main electron lens portion formed of a plurality of grids, each focusing on a target at least one electron beam emitted from the electron beam changes is applied.

Alternatively, one of the two grids connected to each other by the resistor is not fixedly supported by an insulation support for supporting and fixing the grids of the electron gun assembly. This electrode is fixedly supported by at least one grid to which a voltage that dynamically changes, the grid being adjacent to the electrode by means of an dielectric whose specific dielectric constant $\in s$ is 1 or more.

Of course, a dielectric Ci having the above arrangement is disposed so as not to have an effect on electron beam transmission. The dielectric Ci is made of a material that does not substantially have temperature dependency.

With such arrangement, a part of the dynamic voltage supplied to the fourth grid is supplied to the third grid through an electrostatic capacity between the second and third grids and through an electrostatic capacity between the third and fourth grids. Then, a potential difference is generated between the second and third grids, and an asymmetrical lens is operated. In addition, at the same time, voltages applied to the second, third, and fourth grids are changed in synchronism with the deflection magnetic field. Thus, between the second grid and the fourth grid, a cylindrical lens component becomes strong at the same time, the divergence action in the horizontal direction generating section; and a deflection yoke for generating a magnetic field for scanning a screen by the deflected electron beam, wherein an electron beam forming section for generating electron beams is composed of first grid to fourth grid, a first grid of the electron beam forming section is composed of a plate electrode, is grounded at the outside of the tube; or a negative potential is slightly supplied, a second grid is made of a planar electrode, and is connected to a third electrode by a resistor disposed in a the tube; an acceleration voltage of about 600 V to 800 V is supplied to the second grid, this voltage is supplied to the third grid by a resistor disposed in the tube, and a voltage that change in synchronism with a deflection current of the deflection device is applied with a middle level focus voltage of about 7 kV to 9 kV being a reference. Then, an asymmetrical lens is formed between the second lens and the third lens.

Alternatively, in the above arrangement, the second grid side of the third grid has a protruded portion at a peripheral of an electron beam through hole.

Further, there are disposed at least one electrode connected to the resistor; and a dielectric whose specific dielectric constant $\in s$ is 1 or more between at least one electrode connected by the resistor and at least one grid to which a voltage that dynamically between the second and third grids is offset, and operation is effected so as to help the focusing action in the vertical direction.

In the triode, by generating such action, a diameter of a crossover image, i.e., an objective point in the vertical direction is increased as the deflection magnetic field increases. In addition, a divergence angle in the horizontal direction is not increased extremely. Thus, there is achieved an advantageous effect that the diameter of the crossover image is reduced without causing an increase in aberration at the main lens portion due to the spread of the electron beams in the horizontal direction. This makes it possible to eliminate the horizontal elongation phenomenon at the periphery of the screen more efficiently, and cause electron beams to be focused more properly at the periphery of the screen.

At the inside of the electron gun assembly, a potential difference can be generated between the second and third grids. Thus, it becomes unnecessary to newly add a dynamic focus voltage that increases in synchronism with the deflection current of the deflection device with an acceleration voltage having a low level being a reference, and it becomes unnecessary to newly provide a lead wire for supplying a voltage to a stem portion. Therefore, there can be avoided a problem that the lowering of the withstanding voltage due to an increase in this lead wire causes reliability. In addition, in the color picture tube device, it becomes unnecessary to re-design a stem portion for this lead wire increase. At the same time, in the driving device for supplying a voltage also, in particular, it becomes unnecessary to newly add a circuit for forming this dynamic voltage. Therefore, there is no problem that such circuit addition causes higher cost, and a high dignity cathode ray tube can be easily provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
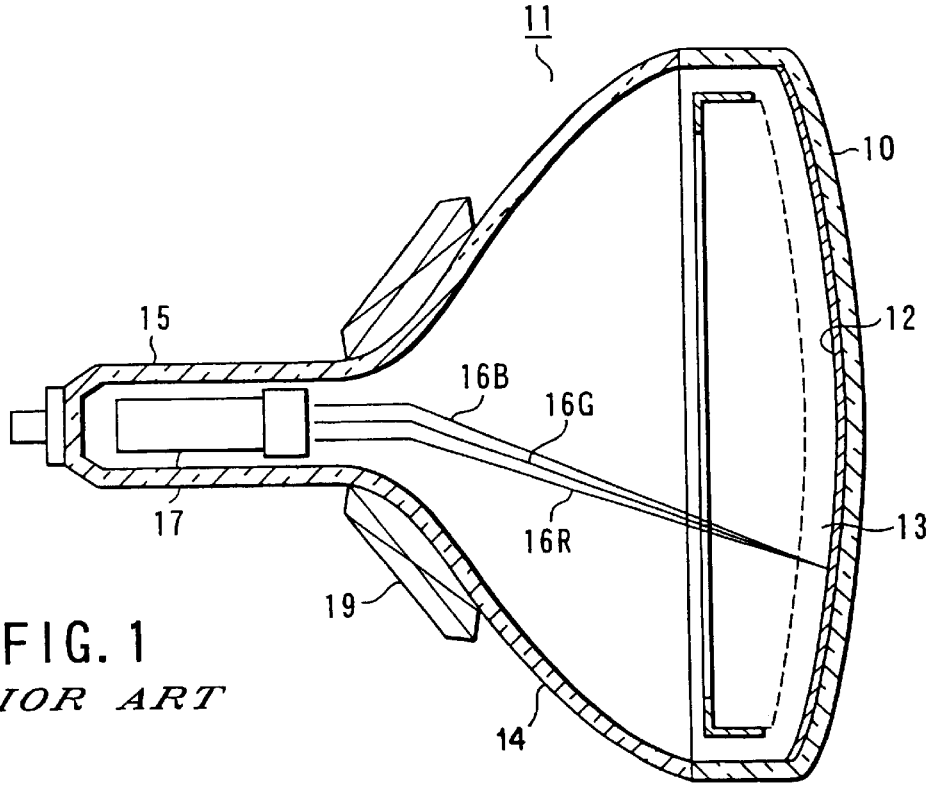
FIG. 1 PRIOR ART
FIG. 1 is a cross section schematically showing a structure of a general color picture tube.
Figure 2A:
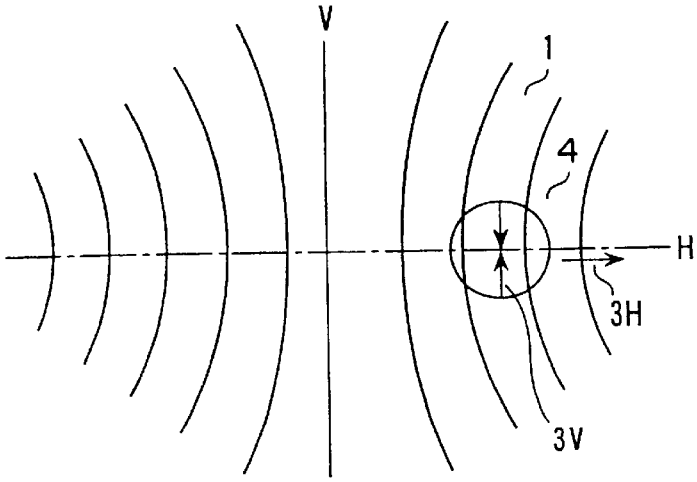
FIG. 2A PRIOR ART
FIG. 2A is an illustrative view for illustrating an effect that pin cushion shaped horizontal deflection magnetic field of a self-convergence inline type color picture tube has on electron beams.
Figure 2B:
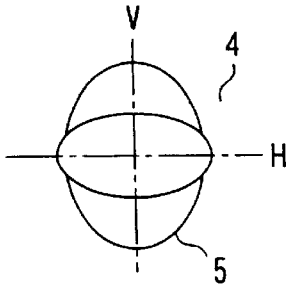
FIG. 2B PRIOR ART
FIG. 2B is an illustrative view showing the shape of a beam spot at the periphery of a screen.
Figure 3:
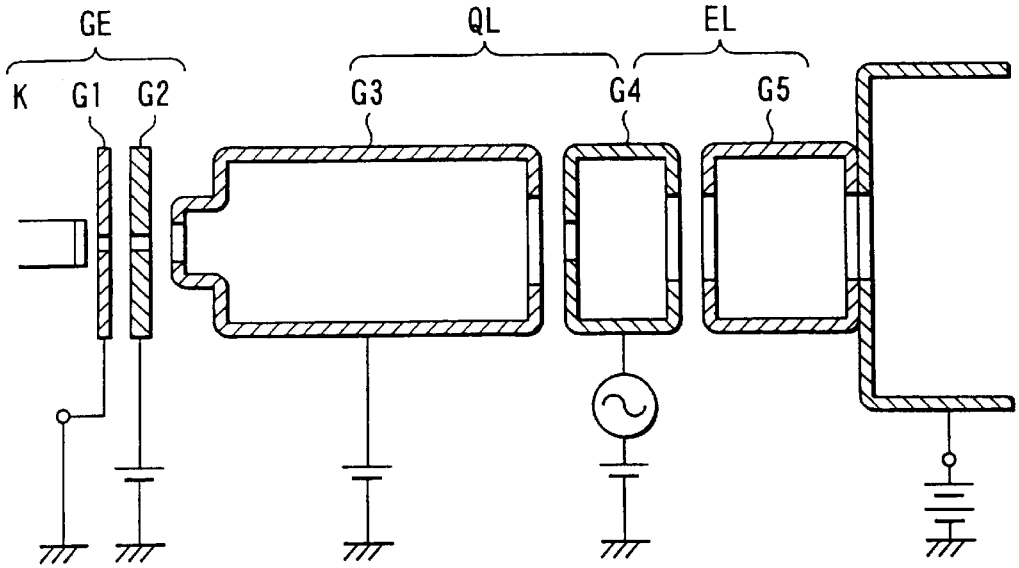
FIG. 3 PRIOR ART
FIG. 3 is a schematic cross section of an electron gun assembly for illustrating a structure of the electron gun assembly incorporated in a conventional color picture tube.
Figure 4A:
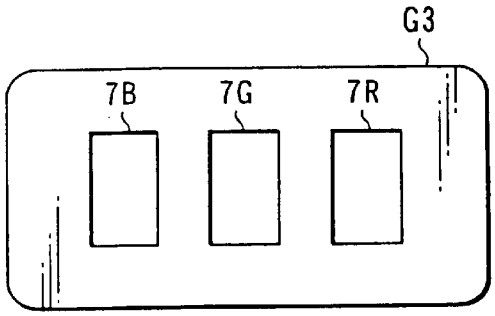
FIG. 4A PRIOR ART
FIG. 4A is a plan view schematically showing an electron beam through hole on a fourth grid side of a third grid configuring the electron gun assembly shown in FIG. 2.
Figure 4B:
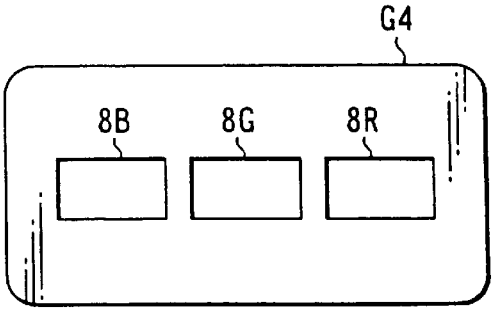
FIG. 4B PRIOR ART
FIG. 4B is a plan view schematically showing an electron beam through hole on a third grid side of a fourth grid configuring the electron gun assembly shown in FIG. 2.
Figure 5A:
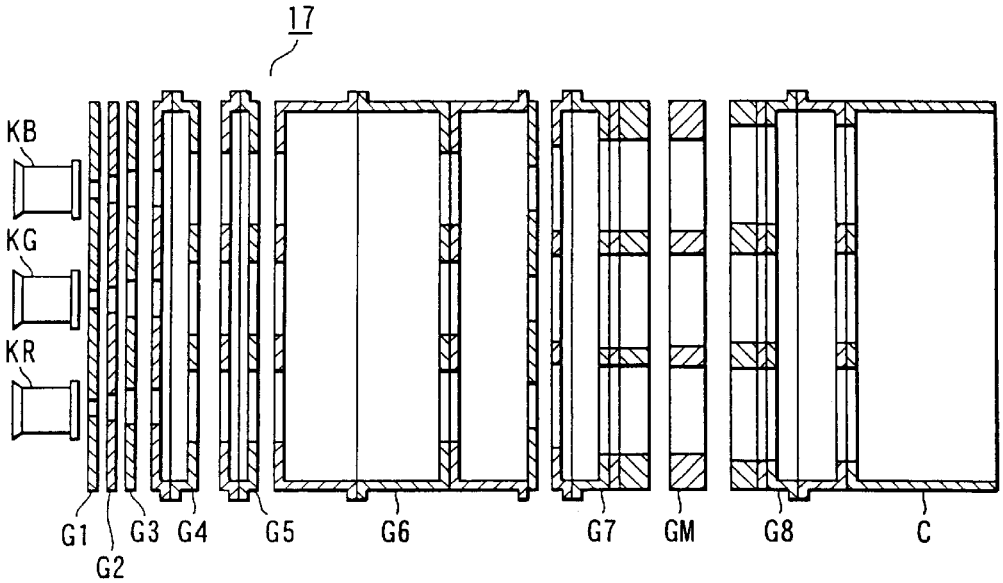
FIG. 5A is a horizontal cross section schematically showing a structure of an electron gun assembly of a color picture tube according to one embodiment of the present invention.
Figure 5B:
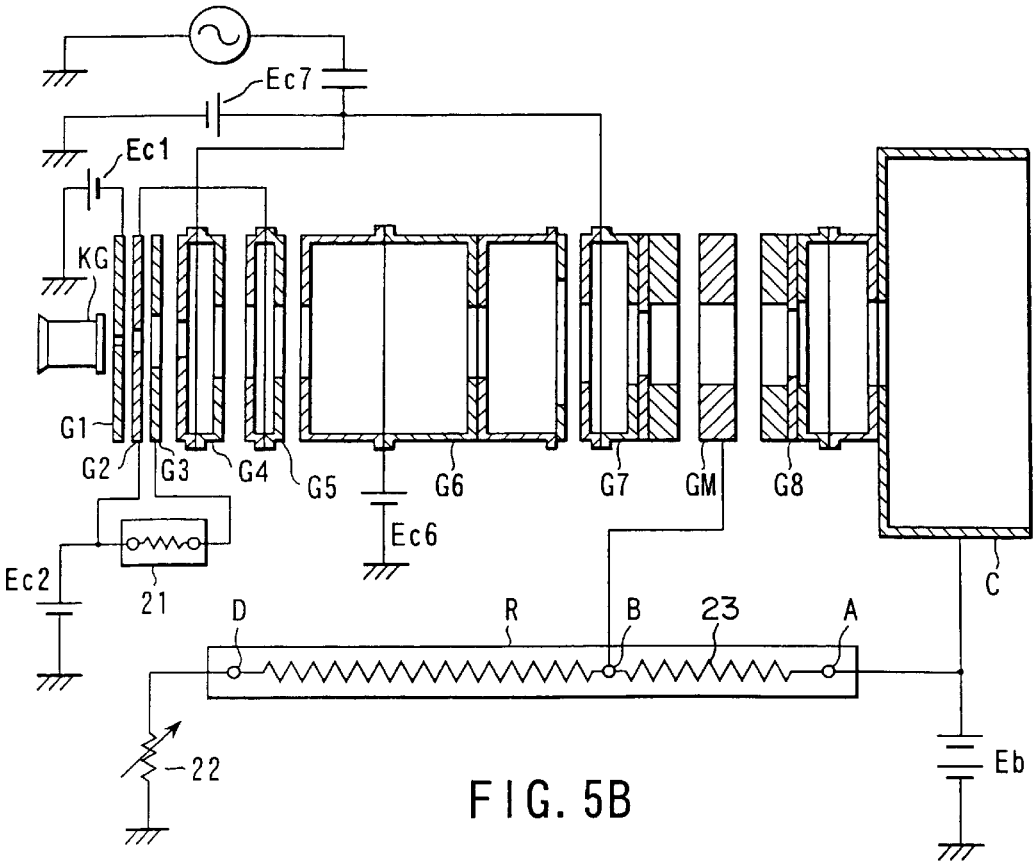
FIG. 5B is a vertical cross section schematically showing a structure of the electron gun assembly shown in FIG. 5A.

Hereinafter, a color cathode ray tube apparatus according to one embodiment of the present invention will be described with reference to the accompanying drawings. FIG. 5A and FIG. 5B are horizontal and vertical cross sections each schematically showing an electron gun assembly of a color picture tube apparatus according to the present invention. This electron gun assembly shown in FIGS. 5A and 5B is received in a neck 15 of a color picture tube having a general structure as shown in FIG. 1. A structure of the color picture tube is described as the prior art with reference to FIG. 1, and reference is made to FIG. 1 and its related description.

As shown in FIG. 5A, an electron gun assembly is provided with three cathodes KB, KG, and KR arranged in line in the horizontal direction in which electron beams are generated and three heaters (not shown) for heating these cathodes. At this electron gun assembly, there are arranged a first grid G1, a second grid G2, a third grid G3, a fourth grid G4, a fifth grid G5, a sixth grid G6, a seventh grid G7, an intermediate electrode (GM), an eight grid (G8), and a convergence cup C in this order. These electrodes are supported with an insulating support rod (not shown).

A resistor R is provided in the vicinity of the electron gun assembly as shown in FIG. 5B; one end thereof is connected to the eighth grid G8 via the convergence cup C; the other end D thereof is grounded outside of the tube via a resistor 22; and an intermediate point B thereof is connected to the intermediate electrode GM. About 50% to 70% of the voltage applied to the eighth grid is applied to this intermediate electrode GM.

The first grid G1 is a thin plate shaped electrode which is provided with three electron beam through holes each having a relatively small diameter that permits the electron beams 16R, 16B, and 16G to pass the holes. The second grid G2 is a thin plate shaped electrode which is provided with three electron beam through holes each having a relatively small diameter, that permits the electron beams 16R, 16B, and 16G to pass.

Figure 6A:
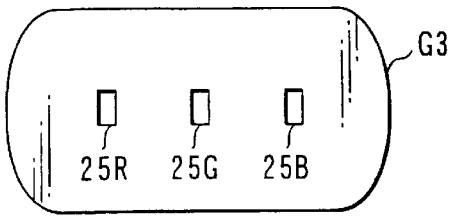
FIG. 6A is a plan view schematically showing an electron beam hole of a third grid of the electron gun assembly shown in FIGS. 5A and 5B.
Figure 6B:
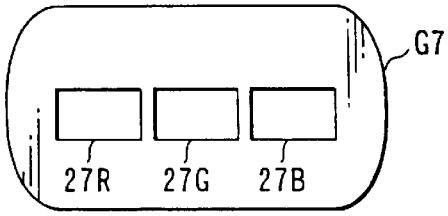
FIG. 6B is a plan view schematically showing a seventh grid of the electron gun assembly shown in FIGS. 5A and 5B, an electron beam through hole being on the sixth grid side.

The third grid G3 consists of a thin plate shaped electrode with its integral structure. At this grid G3, as shown in FIG. 6A, three non-circular, i.e., rectangular electron beam through holes 25B, 25G, and 25R arranged in line in the horizontal direction and each longitudinally elongated in the vertical direction are formed in the grid G3, the through holes being provided for three electron beams emitted from the corresponding cathodes KB, KG, and KR, respectively.

The second grid G2 and the third grid G3 are provided with electron beam through hole and an asymmetrical electron lens is formed between the grids G2 and G3.

The fourth grid G4 has one cup shaped electrode and a thick plate electrode combined with each other and provided with three electron beam through holes, at the third grid side, whose diameters are larger than those of the electron beam through holes of the second grid G2, respectively. The fourth grid G4 also has three through holes, at the fifth grid G5 side, whose diameters are larger than those of the electron beam through holes of the second grid G2, respectively.

The fifth grid G5 is composed of two cup shaped electrodes abutted against each other, and three through holes whose sizes are substantially same as those of the electron beam through holes on the fifth grid G5 side of the fourth grid G4 respectively are formed in the fifth grid G5.

Figure 6C:
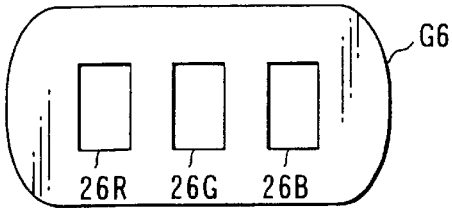
FIG. 6C is a plan view schematically showing a sixth grid of the electron gun assembly an electron beam shown in FIGS. 5A and 5B, an electron beam through hole being on a seventh grid side thereof.
Figure 6D:
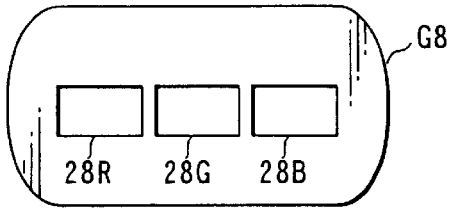
FIG. 6D is a plan view schematically showing an electron beam hole on a planar electrode of an eighth grid of the electron gun assembly shown in FIGS. 5A and 5B.

The sixth grid G6 is composed of two cup shaped electrodes that are arranged along the electron beam traveling direction. On the seventh grid G7 side, as shown in FIG. 6C, three longitudinally elongated through holes 26R, 26G, and 26B for allowing the electron beams to pass therethrough are formed. In addition, the seventh grid G7 is composed of a planer electrode, a cup shaped electrode, and a thick plate electrode which has horizontally elongated electron beam through holes 27R, 27G, 27B, as shown in FIG. 6D. Three through holes each having large diameter are formed on a thick plate electrode opposite to the intermediate electrode GM.

An intermediate electrode GM is a thick plate electrode on which three through holes of their large diameters is formed. The eighth grid G8 has a plate electrode faced to the convergence cup C and provided with relatively large diameter rectangular through holes 28R, 28G, and 28B, as shown in FIG. 6D. The eighth grid G8 also has a plate electrode faced to the seventh grid G7 and relatively large diameter circular through holes. In addition, on two cup shaped electrodes of the convergence cup C, three through holes are formed to be disposed in line, respectively. Furthermore, electrode structure of two-cup electrodes are located and fixed between the eighth grid G8 and the convergence cup C.

In the electron gun assembly shown in FIG. 5A and FIG. 5B, about 100 to 150 V voltage Ek is applied to the three cathodes KB, KG, and KR and the first grid G1 is grounded or connected to a minus voltage Ec1. About 600 to 800 V voltage Ec2 is applied to the second grid G2 and the fourth grid G4, and a similar voltage is applied to the third grid G3 via a resistor 21. An AC voltage synchronized with the deflection magnetic field with about 6 to 9 KV focusing voltage Ec7 being a reference is applied to each of the fourth grid G4 and the seventh grid G7; and about 6 to 9 KV focusing voltage Ec6 is applied to the sixth grid G6. About 25 to 30 KV anode voltage Eb is applied to the eighth electrode GM. In addition, about 50% to 70% of the voltage obtained by dividing the voltage Eb applied to the eighth grid G8 by means of the above resistor 23 is applied to the intermediate electrode GM. Therefore, a main lens of extended electric field type is formed in the seventh grid G7, intermediate grid GM, and eighth grid G8.

With such arrangement, a part of the dynamic voltage supplied to the fourth grid G4 is electrostatic divided by an electrostatic capacity between the second and third grids G2 and G3 and an electrostatic capacity between the third and fourth grids G3 and G4 and is supplied to the third grid G3 via this electrostatic capacity. Then, a potential difference is generated between the second and third grids G2 and G3, and an axially asymmetrical lens is formed.

This axially asymmetrical lens is formed, thereby making it possible to control electrons dynamically at the triode of generating the electron beams in synchronism with the deflection current of the deflection device. At the same time, the focusing state of a main lens and quadruple lens QL disposed at the main lens can be changed. Thus, a horizontal deformed phenomenon can be eliminated more significantly, and electron beams can be focused at the periphery of the screen more properly than a conventional dynamic focus electron gun assembly for changing the focusing state of a main lens and the quadruple lens QL disposed at the main lens.

That is, as the deflection magnetic field is generated, an axially symmetrical lens between the second and third grids G2 and G3 works so as to have the divergence action in the relatively horizontal direction and the focusing action in the vertical direction. In addition, at the same time, voltages applied to the second, third, and fourth grids G2, G3, and G4 are changed in synchronism with the deflection magnetic field. Thus, a cylindrical lens component becomes strong simultaneously between the second grid G2 and the fourth grid G4; the divergence action in the horizontal direction between the second and third grids G2 and G3 is substantially offset, and operation is effected so as to help the focusing action in the vertical direction.

Such action is generated at a triode portion, whereby the cross over diameter or objective diameter of the electron beam in the vertical direction is increased as the deflection magnetic field increases. In addition, the divergence angle in the horizontal direction is not extremely increased, and thus, there is achieved an advantageous effect that the objective diameter in the horizontal direction is reduced without causing an increase in aberration at the main lens due to divergence of the electron beam in the horizontal direction. In this manner, a horizontal elongated or deformed phenomenon at the periphery of the screen can be eliminated more efficiently, and electron beams can be focused at the periphery of the screen more properly than the conventional electron gun assembly.

At the inside of the electron gun assembly, a potential difference can be generated between the second and third grids G2 and G3. This makes it unnecessary to newly add a dynamic focus voltage that increases in synchronism with the deflection current of the deflection device with an acceleration voltage having a low level being a reference, and makes it unnecessary to newly provide a lead wire for supplying a voltage to a stem portion. In addition, in the color picture tube device, it becomes unnecessary to re-design the stem portion for this lead wire increase. At the same time, in the driving device for supplying a voltage also, it becomes unnecessary to newly add a circuit for forming a dynamic voltage. Therefore, there is no problem with higher cost, and a high dignity cathode ray tube can be easily provided.

Figure 7:
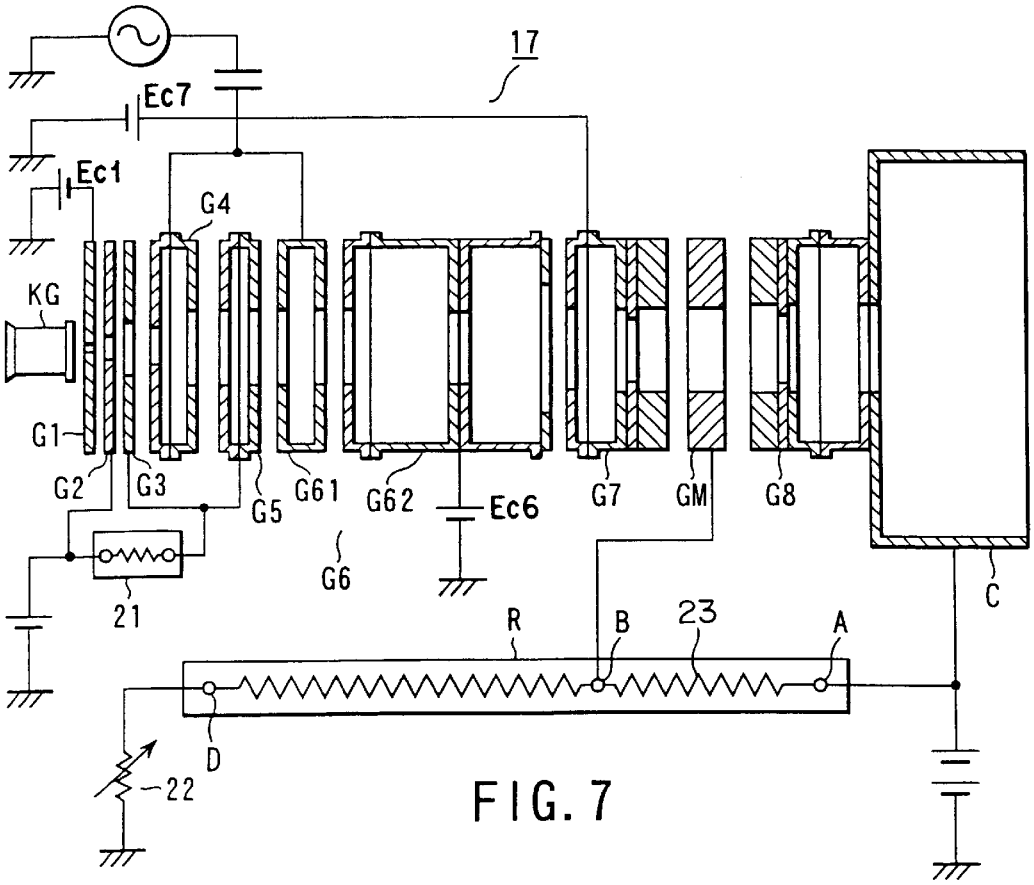
FIG. 7 is a vertical cross section schematically showing a structure of an electron gun assembly incorporated in a color picture tube according to another embodiment of the present invention.

In the illustrative embodiment, although the third grid G3 and the fifth grid G5 are connected to each other, for example, as shown in FIG. 7, the sixth grid G6 may be divided into two section; i.e., a G61 grid G61 and a G62 grid G62, and a G61 grid G61 on the fifth grid side and the fourth grid G4 are connected to each other. The second grid G2 and fifth grid G5 connected by the resistor 21 are connected to each other, whereby the electrostatic capacity between the third and fourth grids G3 and G4 is set to have a capacitance larger than that between the second and third grids G2 and G3. Thus, a dynamic voltage can be superimposed on the third grid G3 more efficiently, and a potential difference between the second and third grids can be increased. Namely, a change in the objective diameter at a triode portion can be increased, and a horizontally deformed phenomenon at the periphery of the screen can be eliminated more efficiently.

Figure 8A:
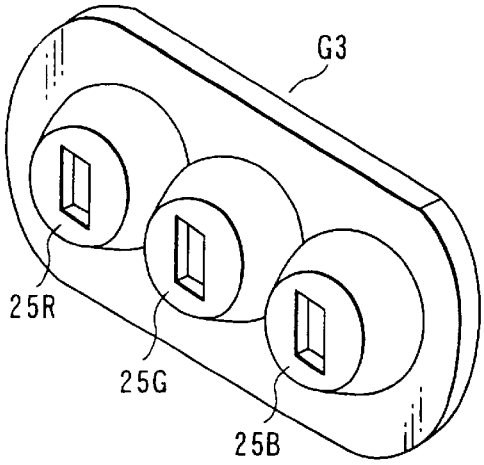
FIG. 8A and FIG. 8B are perspective views schematically showing a third grid having its different shape of the electron gun assembly shown in FIG. 7.
Figure 8B:
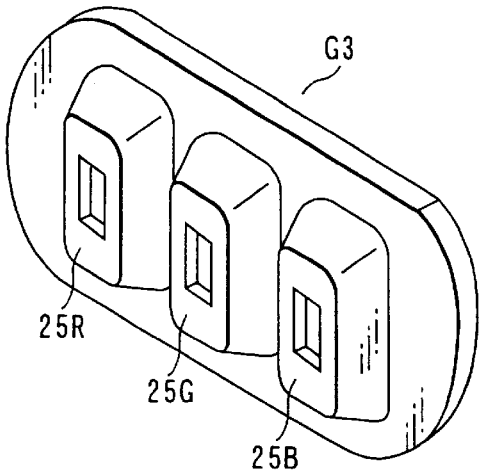

In addition, in the embodiment, although the third grid is formed in a thin plate shape, for example, as shown in FIG. 8A and FIG. 8B, only the periphery of the through hole may be protruded to the second grid side. In this manner, the electrostatic capacitance between the second and third grids G2 and G3 can be reduced; an electrostatic capacitance between the third and fourth grids G3 and G4 can be relatively increased more significantly than that between the second and third grids G2 and G3; and an advantageous effect of the present invention can be achieved significantly.

Figure 9A:
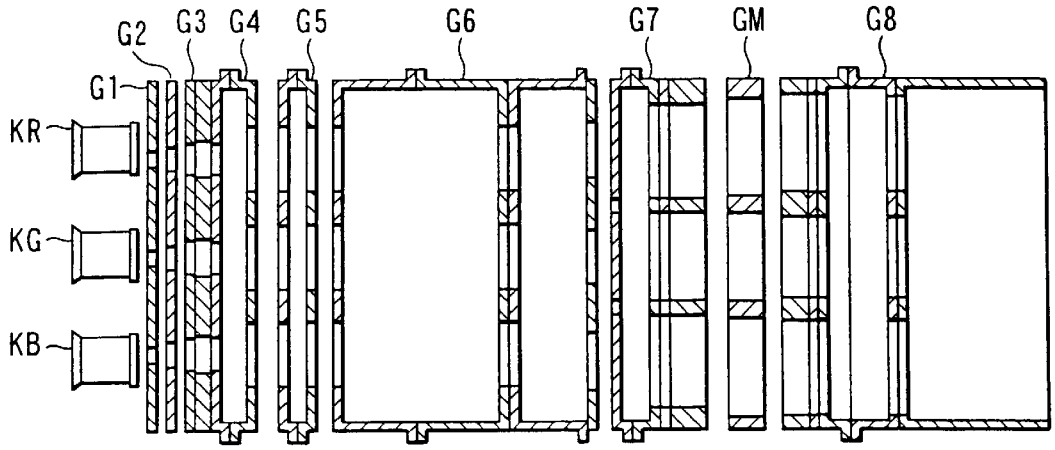
FIG. 9A is a horizontal cross section schematically showing a structure of an electron gun assembly incorporated in the color picture tube according to a further embodiment of the present invention.
Figure 9B:
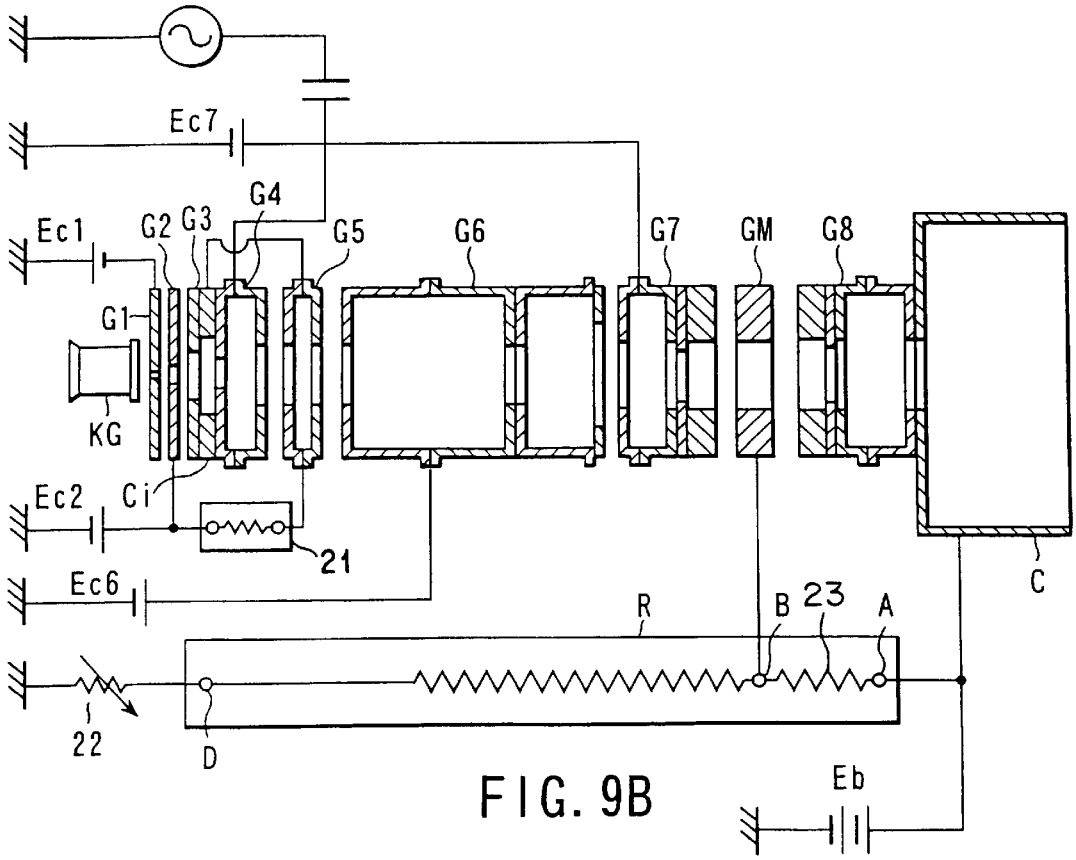
FIG. 9B is a vertical cross section schematically showing a structure of the electron gun assembly shown in FIG. 9A similarly.

Further, as shown in FIG. 9A and FIG. 9B, a dielectric Ci whose specific dielectric constant $\in s$ is 1 or more may be disposed between the third grid G3 and the fourth grid G4. In the embodiment shown in FIG. 9A and FIG. 9B, this third grid G3 can be structured so as not to be fixedly supported by an insulation support body for fixedly supporting a grid of an electrode gun, and so as to be fixedly supported by the fourth grid G4. In the electron gun assembly shown in FIG. 9B, the third and fifth grids G3 and G5 are connected each other and the resistor 21 is connected between the fifth and second grids G5 and G2. Thus, the third grid G3 is connected to the resistor 21 through the fifth grid G5.

With such arrangement, an electrostatic capacitance between the third grid G3 and the fourth grid G4 can be further increased, and thus, an advantageous effect of the present invention can be achieved significantly.

Figure 10:
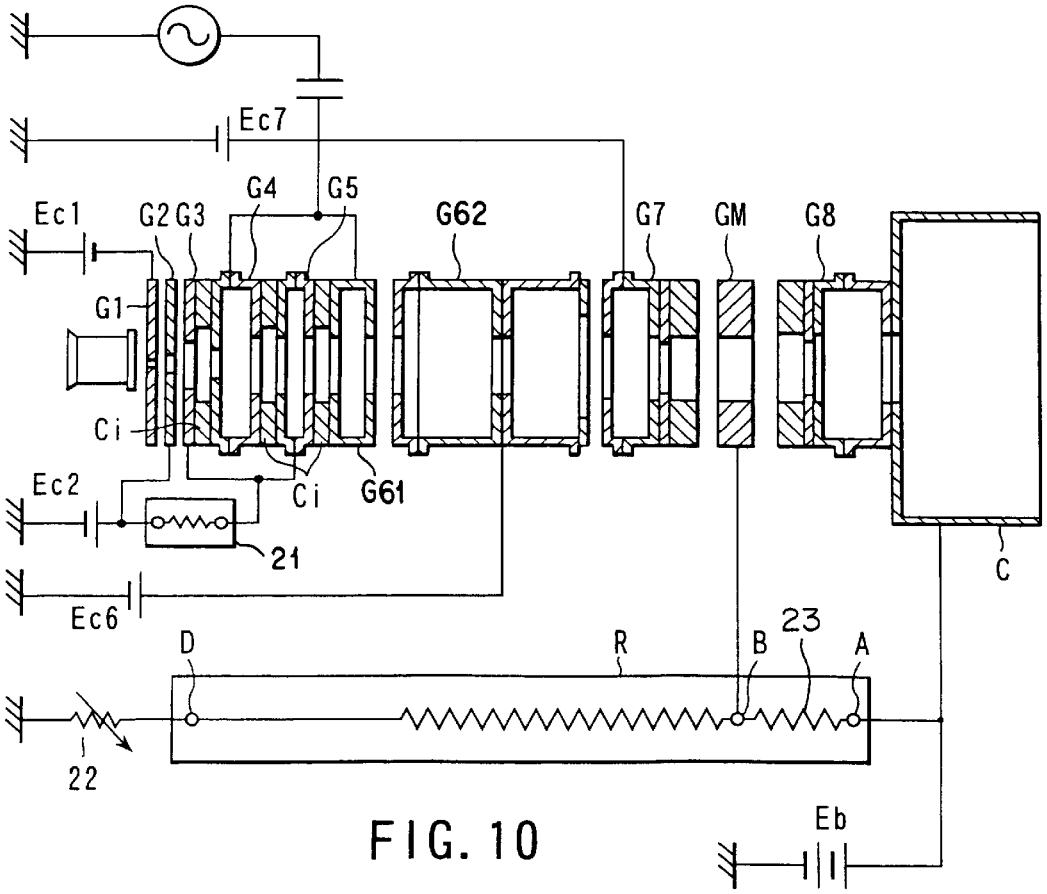
FIG. 10 is a vertical cross section schematically showing a structure of an electron gun assembly incorporated in a color image tube according to a still further embodiment of the present invention.

Furthermore, as a method for further increasing this electrostatic capacitance between the third grid G3 and the fourth grid G4, as shown in FIG. 10, the sixth grid may be divided into two section, i.e., a G61 grid G61 and a G61 grid G62; the G61 grid G61 on the fifth grid side and a fourth grid G4 are connected to each other; and dielectrics Ci may be provided between the third and fourth grids G3 and G4, between the fourth and fifth grids G4 and G5, and between the fifth grid G5 and the G61 grid 61. With such structure, a dynamic voltage is applied to the third grid G3, and an axially symmetrical lens is formed between the second and third grids G2 and G3 so as to be operated.

Of course, the dielectric Ci having the above configuration is disposed so as to pass electron beam therethrough. In addition, it is preferable that the temperature dependency of the dielectric Ci be substantially free of any problem, i.e., a change in dielectric be slight.

In the above illustrative embodiment, when the frequency of a deflection magnetic field is designated by 'f', the resistance values of resistors connected to the second grid G2 and the third grid G3 are designated by R, an electrostatic capacity between the second grid G2 and the third grid G3 is designated by Cb, the following condition must be met:

$$\pi^2 \times f \times R \geqq 13 \times (1-r)$$

where $$r = Ca/(Ca+Cb)$$

The electrode structure of the electron gun assembly is designed so as to meet the above condition, whereby an asymmetrical lens is formed efficiently.

In addition, in the above embodiment, although an extension electric field type main lens having a main lens portion composed of one intermediate electrode is provided, an extension type electric field lens having two or more intermediate electrodes or either of a general high potential type main lens and a uni-potential type main lens may be provided without being limited thereto.

As has been described above, there is provided a cathode ray tube comprising at least an electron beam generating section; an electron gun assembly having a main electron lens portion formed of a plurality of grids for focusing at least one electron beam emitted from the electron beam generating section onto a target; and a deflection yoke for generating a magnetic field for deflecting and scanning the electron beam emitted from the electron gun assembly onto the target, wherein an electron beam forming section composed of a first grid to a fourth grid is present, a main lens portion is formed of a plurality of grids including the fourth grid, a first grid of the electron beam forming section is composed of a planar electrode, and is grounded outside of the tube; or a negative potential is supplied, a second grid is a planar electrode, and is connected by resistors disposed at the third grid and inside of the tube, an acceleration voltage of about 600 V to 800 V is supplied to the second grid, and is made so that this voltage is supplied among the third grids by means of a resistor disposed in the tube, a voltage that change in synchronism with the deflection current of the deflection device is applied to the fourth grid with a middle level focus voltage of about 7 kV to 9 kV being a reference. In addition, an arrangement is provided such that an asymmetrical lens is formed between the second grid and the third grid.

Alternatively, in the above arrangement, the third grid has a protruded portion at the periphery of the through hole of the third grid at the second grid side.

With such arrangement, a part of the dynamic voltage supplied to the fourth grid is supplied to the third grid by being electrostatic divided by an electrostatic capacity between the second and third grids and a electrostatic capacity between the third and fourth grids; and a potential difference is generated between the second and third grids, so that an asymmetrical lens operates. In addition, at the same time, voltages applied to the second, third, and fourth grids are changed in synchronism with the deflection magnetic field. Thus, a cylindrical lens component becomes strong simultaneously between the second grid and the fourth grid, the divergence action in the horizontal direction between the second and third grids is substantially offset, and operation is effected so as to help the focusing action in the vertical direction.

In the triode portion, by generating such action, the objective diameter or cross over point diameter is increased as the deflection magnetic field increases. In addition, the divergence angle in the horizontal direction is not extremely increased. Thus, there is achieved an advantageous effect that the objective diameter or cross-over point diameter is reduced without causing an increase in aberration at the main lens portion due to spread of the electron beams in the horizontal direction. This makes it possible to eliminate a horizontal crush phenomenon at the periphery of the screen more efficiently, and focusing electron beams at the periphery of the screen more properly.

At the inside of the electron gun assembly, a potential difference can be generated between the second and third grids. Thus, it becomes unnecessary to newly add a dynamic focus voltage that increases in synchronism with the deflection current of the deflection device with reference to an acceleration voltage having a low level, and it becomes unnecessary to newly provide a lead wire for supplying a voltage to a stem portion. Therefore, there can be avoided a problem that the lowering of the withstanding voltage due to an increase in this lead wire causes reliability. In addition, in the color picture tube device, it becomes unnecessary to re-design a stem portion for this lead wire increase. At the same time, in the driving device for supplying a voltage also, in particular, it becomes unnecessary to newly add a circuit for forming this dynamic voltage. Therefore, there is no problem that such circuit addition causes higher cost, and a high dignity cathode ray tube can be easily provided, which makes its industrial significance greater.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus having a screen, comprising:

an electron gun assembly provided with electron beam forming means for generating and emitting at least one electron beam, said electron beam forming means including a cathode and a plurality of electrodes disposed along an electron beam traveling direction, and a main focus lens for focusing the electron beam from the cathode on the screen; and a deflection yoke for generating a deflection magnetic field deflecting the electron beam in horizontal and vertical directions to scan the screen with the deflected electron beam, wherein the main focus lens of the electron gun assembly is formed by focus electrodes and an anode electrode, focus voltages having intermediate voltage levels being applied to the focus electrodes from an outside of the electron gun assembly and an anode voltage having a high voltage level being applied to the anode electrode, the focus electrodes including at least one focus electrode to which a constant focus voltage is applied from the outside of a tube, and at least one dynamic focus electrode to which a dynamic focus voltage varied in synchronism with the deflection magnetic field generated from the deflection yoke is applied, and a resistor being connected to at least two electrodes which constitutes the electron beam forming means, a fixed voltage being applied from an outside of the tube to the one of the electrodes connected to the resistor, the another one of the electrodes connected to the resistor is so arranged to face the dynamic focus electrode to which the dynamic focus voltage varied in synchronism with the deflection magnetic field generated from the deflection yoke is applied to form the main lens, and axially asymmetrical lens forming means for forming an axially asymmetrical lens being formed between the at least two electrodes connected to the resistor.

2. A cathode ray tube apparatus according to claim 1, wherein the two electrodes connected to the resistor are closely arranged.

3. A cathode ray tube apparatus according to claim 1, wherein said electron beam forming means includes first, second, third and fourth electrodes which are arranged in this order between the cathode and anode electrode, the fixed voltage being applied to the second electrode from an outside of the tube, the voltage which is varied in synchronism with the deflection magnetic field generated from the deflection yoke being applied to the fourth electrode.

4. A cathode ray tube apparatus according to claim 1, wherein an electrostatic capacitance between one of the two electrodes connected to the resistor and the electrode to which the voltage varied in synchronism with the deflection magnetic field generated from the deflection yoke is applied, is greater than that between the two electrodes connected to the resistor.

5. A cathode ray tube apparatus according to claim 1, wherein at least one of the two electrodes connected to the resistor has an opening section protruded from the one electrode.

6. A cathode ray tube apparatus according to claim 1, wherein a dielectric whose specific dielectric constant $\in$ is not smaller than 1 is disposed between one of the two electrodes connected to the resistor and at least one electrode which is closely arranged to the one electrode connected to the resistor and to which the voltage varied in synchronism with the deflection magnetic field generated from the deflection yoke is applied.

7. A cathode ray tube apparatus according to claim 1, wherein a dielectric whose specific dielectric constant $\in s$ is 1 or more is fixed to one of the two electrodes connected to the resistor, and at least one electrode which is closely arranged to the one electrode connected to the resistor and to which the voltage varied in synchronism with the deflection magnetic field generated from the deflection yoke is applied.

8. A cathode ray tube apparatus having a screen, comprising:

an electron gun assembly including, electron beam forming means for generating and emitting at least one electron beam, said electron beam forming means including a cathode and at least first, second, and third electrodes disposed along an electron beam traveling direction, a resistor connecting said first and second electrodes to each other, an axially asymmetrical lens being formed between said first electrode and the second electrode adjacent to the first electrode, and a main focusing lens for focusing the electron beam from the electron beam forming means on the screen, the main focusing lens including at least fourth and fifth electrodes and an anode electrode, the second and third electrodes facing each other;

a deflection yoke for deflecting the electron beam emitted from the electron gun assembly in horizontal and vertical directions and generating deflection magnetic field for scanning the screen with the deflected electron beam; and first applying means for applying a constant voltage to said first electrode and second electrode via said resistor, and for applying to the third electrode a dynamic voltage that changes in synchronism with the deflection magnetic field generated from said deflection yoke.

9. A cathode ray tube apparatus according to claim 8, further comprising second applying means for applying an intermediate level focus voltage to said fifth electrode, for applying a high level anode voltage to the anode electrode, and for applying to said fourth electrode a dynamic focus voltage that is varied in synchronism with the deflection magnetic field which said deflection yoke generates.

10. A cathode ray tube apparatus according to claim 8, wherein said first and second electrodes are disposed adjacent to each other.

11. A cathode ray tube apparatus according to claim 8, wherein an electrostatic capacitance between the second electrode and the third electrode is greater than that between the first and second electrodes.

12. A cathode ray tube apparatus according to claim 8, wherein at least one of said first and second electrodes has a opening section protruded from the one electrode.

13. A cathode ray tube apparatus according to claim 8, wherein a dielectric whose specific dielectric constant ∈ is not smaller than 1 is disposed between said second electrode and the third electrode disposed in the second electrode, the third electrode having a dynamically changing voltage applied thereto.

14. A cathode ray tube apparatus according to claim 8, wherein said second electrode is fixedly supported to the third electrode in the vicinity of the second electrode by a dielectric having the specific dielectric constant ∈s.

15. A cathode ray tube apparatus having a screen, comprising:

an electron gun assembly including, electron beam forming means for generating and emitting at least one electron beam, said electron beam forming means including a cathode and at least first, second, and third electrodes disposed along the electron beam traveling direction from the cathode, a resistor connecting the first and second electrodes to each other, an axially asymmetrical lens being formed between said first electrode and the second electrode adjacent to the first electrode, and a main focusing lens for focusing the electron beams from the electron beam forming means on the screen, the main focusing lens including at least fourth and fifth electrodes and an anode electrode, the second and third electrodes facing each other and the second and fourth electrodes being connected to each other;

a deflection yoke for deflecting the electron beam emitted from the electron gun assembly in horizontal and vertical directions, the deflection yoke generating a deflection magnetic field for scanning the screen with the deflected beam; and first applying means for applying a constant voltage to said first, second and fourth electrodes via said resistor, and for applying to the third and fifth electrodes a dynamic voltage that changes in synchronism with the deflection magnetic field generated from the deflection yoke.

16. A cathode ray tube apparatus according to claim 15, wherein said electron beam forming means further includes a sixth electrode and seventh electrode, and said tube apparatus further comprises:

second applying means for applying an intermediate level focus voltage to said sixth electrode, for applying a high level anode voltage to the anode electrode, and for applying to said seventh electrode a dynamic focus voltage that changes in synchronism with the deflection magnetic field from which said deflection yoke is generated.

17. A cathode ray tube apparatus according to claim 15, wherein said first and second electrodes are disposed adjacent to each other.

18. A cathode ray tube apparatus according to claim 15, wherein an electrostatic capacitance between the second electrode and the third electrode is greater than that between the first and second electrodes.

19. A cathode ray tube apparatus according to claim 15, wherein at least one of said first and second electrodes has a opening section protruded from the one electrode.

20. A cathode ray tube apparatus according to claim 15, wherein a dielectric whose specific dielectric constant ∈s is not smaller than 1 is disposed between said second electrode and the third electrode disposed in the second electrode, the third electrode having a dynamically changing voltage applied thereto.

21. A cathode ray tube apparatus according to claim 15, wherein said second electrode is fixedly supported to the third electrode in the vicinity of the second electrode by means of said dielectric having the specific dielectric constant ∈s.

22. A cathode ray tube apparatus having a screen, comprising:

an electron gun assembly provided with an electron beam generator configured to generate and emit at least one electron beam, said electron beam generator including a cathode and a plurality of electrodes disposed along an electron beam traveling direction, and a main focus lens configured to focus the electron beam from the cathode on the screen; and a deflection yoke configured to generate a deflection magnetic field deflecting the electron beam in horizontal and vertical directions to scan the screen with the deflected electron beam, wherein the main focus lens of the electron gun assembly is formed by focus electrodes and an anode electrode, focus voltages having intermediate voltage levels being applied to the focus electrodes from an outside of the electron gun assembly and an anode voltage having a high voltage level being applied to the anode electrode, the focus electrodes including at least one focus electrode to which a constant focus voltage is applied from the outside of a tube, and at least one dynamic focus electrode to which a dynamic focus voltage varied in synchronism with the deflection magnetic field generated from the deflection yoke is applied, and a resistor being connected to at least two electrodes forming the electron beam generator, a fixed voltage being applied from an outside of the tube to the one of the electrodes connected to the resistor, the another one of the electrodes connected to the resistor is so arranged to face the dynamic focus electrode to which the dynamic focus voltage varied in synchronism with the deflection magnetic field generated from the deflection yoke is applied to form the main lens, and an axially asymmetrical lens formed between the at least two electrodes connected to the resistor.

23. A cathode ray tube apparatus according to claim 22, wherein the two electrodes connected to the resistor are closely arranged.

24. A cathode ray tube apparatus according to claim 22, wherein said electron beam generator includes first, second, third and fourth electrodes which are arranged in this order between the cathode and anode electrode, the fixed voltage being applied to the second electrode from an outside of the tube, the voltage which is varied in synchronism with the deflection magnetic field generated from the deflection yoke being applied to the fourth electrode.

25. A cathode ray tube apparatus according to claim 22, wherein an electrostatic capacitance between one of the two electrodes connected to the resistor and the electrode to which the voltage varied in synchronism with the deflection magnetic field generated from the deflection yoke is applied, is greater than that between the two electrodes connected to the resistor.

26. A cathode ray tube apparatus according to claim 22, wherein at least one of the two electrodes connected to the resistor has an opening section protruded from the one electrode.

27. A cathode ray tube apparatus according to claim 22, wherein a dielectric whose specific dielectric constant ∈ is not smaller than 1 is disposed between one of the two electrodes connected to the resistor and at least one electrode which is closely arranged to the one electrode connected to the resistor and to which the voltage varied in synchronism with the deflection magnetic field generated from the deflection yoke is applied.

28. A cathode ray tube apparatus according to claim 22, wherein a dielectric whose specific dielectric constant ∈s is 1 or more is fixed to one of the two electrodes connected to the resistor, and at least one electrode which is closely arranged to the one electrode connected to the resistor and to which the voltage varied in synchronism with the deflection magnetic field generated from the deflection yoke is applied.

29. A cathode ray tube apparatus having a screen, comprising:

an electron gun assembly including, an electron beam generator configured to generate and emit at least one electron beam, said electron beam generator including a cathode and at least first, second, and third electrodes disposed along an electron beam traveling direction, a resistor connecting said first and second electrodes to each other, and an axially asymmetrical lens formed between said first electrode and the second electrode adjacent to the first electrode, and a main focusing lens configured to focus the electron beam from the electron beam generator on the screen, the main focusing lens including at least fourth and fifth electrodes and an anode electrode, the second and third electrodes facing each other;

a deflection yoke configured to deflect the electron beam emitted from the electron gun assembly in horizontal and vertical directions and generating deflection magnetic field for scanning the screen with the deflected electron beam; and a first applying circuit configured to apply a constant voltage to said first electrode and second electrode via said resistor, and to apply to the third electrode a dynamic voltage that changes in synchronism with the deflection magnetic field generated from said deflection yoke.

30. A cathode ray tube apparatus according to claim 29, further comprising a second applying circuit configured to apply an intermediate level focus voltage to said fifth electrode, to apply a high level anode voltage to the anode electrode, and to apply to said fourth electrode a dynamic focus voltage that is varied in synchronism with the deflection magnetic field which said deflection yoke generates.

31. A cathode ray tube apparatus according to claim 29, wherein said first and second electrodes are disposed adjacent to each other.

32. A cathode ray tube apparatus according to claim 29, wherein an electrostatic capacitance between the second electrode and the third electrode is greater than that between the first and second electrodes.

33. A cathode ray tube apparatus according to claim 29, wherein at least one of said first and second electrodes has a opening section protruded from the one electrode.

34. A cathode ray tube apparatus according to claim 29, wherein a dielectric whose specific dielectric constant ∈ is not smaller than 1 is disposed between said second electrode and the third electrode disposed in the second electrode, the third electrode having a dynamically changing voltage applied thereto.

35. A cathode ray tube apparatus according to claim 29, wherein said second electrode is fixedly supported to the third electrode in the vicinity of the second electrode by a dielectric having the specific dielectric constant ∈s.

36. A cathode ray tube apparatus having a screen, comprising:

an electron gun assembly including, an electron beam generator configured to generate and emit at least one electron beam, said electron beam generator including a cathode and at least first, second, and third electrodes disposed along the electron beam traveling direction from the cathode, a resistor connecting the first and second electrodes to each other, and an axially asymmetrical lens formed between said first electrode and the second electrode adjacent to the first electrode, and a main focusing lens configured to focus the electron beams from the electron beam generator on the screen, the main focusing lens including at least fourth and fifth electrodes and an anode electrode, the second and third electrodes facing each other and the second and fourth electrodes being connected to each other;

a deflection yoke configured to deflect the electron beam emitted from the electron gun assembly in horizontal and vertical directions, the deflection yoke generating a deflection magnetic field for scanning the screen with the deflected beam; and a first applying circuit configured to apply a constant voltage to said first, second and fourth electrodes via said resistor, and to apply to the third and fifth electrodes a dynamic voltage that changes in synchronism with the deflection magnetic field generated from the deflection yoke.

37. A cathode ray tube apparatus according to claim 36, wherein said electron beam generator further includes a sixth electrode and seventh electrode, and said tube apparatus further comprises:

a second applying circuit configured to apply an intermediate level focus voltage to said sixth electrode, to apply a high level anode voltage to the anode electrode, and to apply to said seventh electrode a dynamic focus voltage that changes in synchronism with the deflection magnetic field from which said deflection yoke is generated.

38. A cathode ray tube apparatus according to claim 36, wherein said first and second electrodes are disposed adjacent to each other.

39. A cathode ray tube apparatus according to claim 36, wherein an electrostatic capacitance between the second electrode and the third electrode is greater than that between the first and second electrodes.

40. A cathode ray tube apparatus according to claim 36, wherein at least one of said first and second electrodes has a opening section protruded from the one electrode.

41. A cathode ray tube apparatus according to claim 36, wherein a dielectric whose specific dielectric constant ∈s is not smaller than 1 is disposed between said second electrode and the third electrode disposed in the second electrode, the third electrode having a dynamically changing voltage applied thereto.

42. A cathode ray tube apparatus according to claim 36, wherein said second electrode is fixedly supported to the third electrode in the vicinity of the second electrode by means of said dielectric having the specific dielectric constant ∈s.

* * * * *